United States Patent [19]

Burk et al.

[11] Patent Number: 4,969,341

[45] Date of Patent: Nov. 13, 1990

[54] AUTOMATIC WASHER BASKET AN AGITATOR DRIVE SYSTEM

[75] Inventors: Jeffrey L. Burk, Lincoln Township, Berrien County; Douglas E. Wood, Hagar Township, Berrien County, both of Mich.

[73] Assignee: Whirlpool Corporation, Benton Harbor, Mich.

[21] Appl. No.: 461,324

[22] Filed: Jan. 5, 1990

[51] Int. Cl.[5] ..... D06F 23/04; D06F 37/40

[52] U.S. Cl. ..... 68/23.700; 192/46; 192/89 A; 192/108

[58] Field of Search ..... 68/23.7; 192/46, 89 A, 192/108

[56] References Cited

U.S. PATENT DOCUMENTS

| | | | |
|---|---|---|---|
| 1,254,372 | 1/1918 | Stanley . | |
| 2,130,855 | 9/1938 | Oliver . | |
| 2,185,109 | 12/1939 | Williams et al. . | |
| 2,249,187 | 7/1941 | Steiner | 192/89 A |
| 2,298,905 | 10/1942 | Skinner . | |
| 2,398,570 | 4/1946 | Wildhaber | 192/108 X |
| 3,224,535 | 12/1965 | Herbkersman | 192/108 X |
| 3,433,337 | 3/1969 | Salter | 192/46 |
| 3,743,067 | 7/1973 | Bokovoy | 192/46 X |
| 4,155,228 | 5/1979 | Burgener, Jr. et al. | 192/46 X |
| 4,255,952 | 3/1981 | Johnson | 68/23.7 |
| 4,291,566 | 9/1981 | Mason | 68/23.7 |
| 4,317,343 | 3/1982 | Gerry | 68/23.7 |

*Primary Examiner*—Philip R. Coe

*Attorney, Agent, or Firm*—Hill, Van Santen, Steadman & Simpson

[57] ABSTRACT

A clutch mechanism is provided for the drive system of an automatic washer having a vertical axis agitator, a concentrically mounted wash basket, and a motor drivingly connected to the agitator to selectively oscillate or rotate the agitator about a vertical axis. The clutch mechanism selectively drivingly connects the wash basket with the motor for simultaneous rotation of the wash basket with the agitator during a water extraction mode of the washer. The clutch mechanism includes a first clutch member drivingly connected to the motor, and a second clutch member drivingly connected to the wash basket and selectively axially actuable for driving engagement with the first clutch member. A stationary cam housing is located adajcent the second clutch member, and a rotatable ring is disposed between the cam housing and the second clutch member. Cam elements are provided between the ring and the cam housing for selectively actuating the second clutch member into driving engagement with the first clutch member upon rotation of the ring within the cam housing. Opposing engagement surfaces of the clutch members are provided with alternating radially extending splines and grooves having a generally sawtooth profile. The splines of one of the clutch members are provided with squared tips, and the grooves of the other clutch member are provided with squared recesses, so that the shape of the corresponding splines and recesses provide an easily achieved yet secure connection when the clutch members are drivingly engaged.

20 Claims, 2 Drawing Sheets

FIG. 5
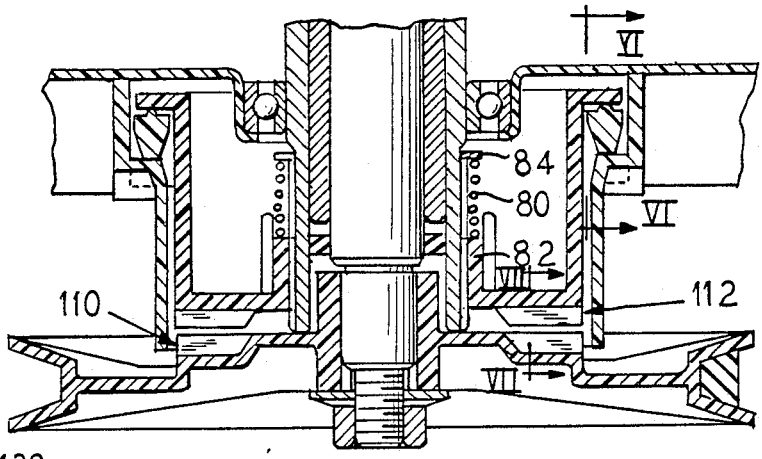
FIG. 8
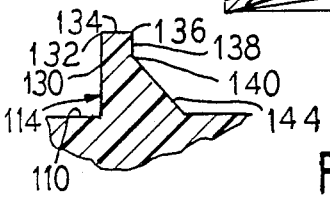
FIG. 7
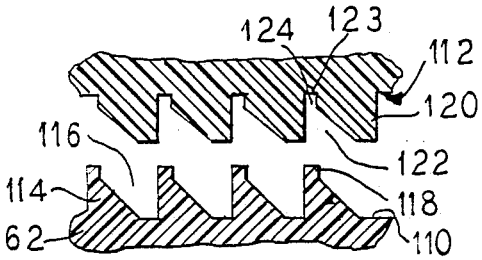
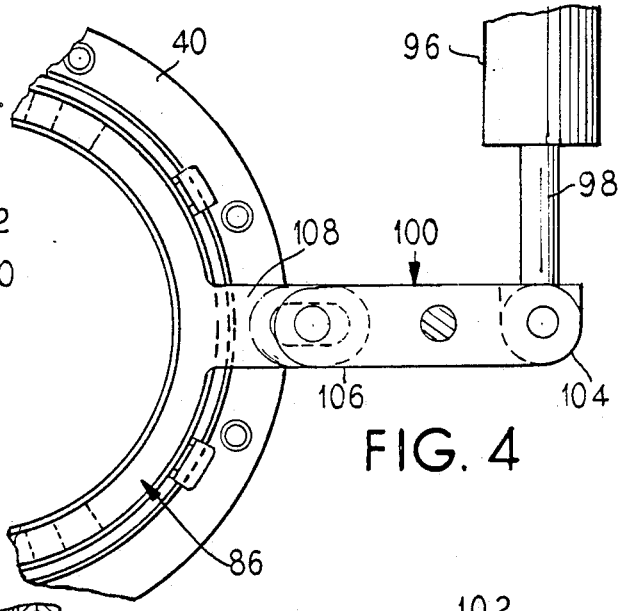
FIG. 4
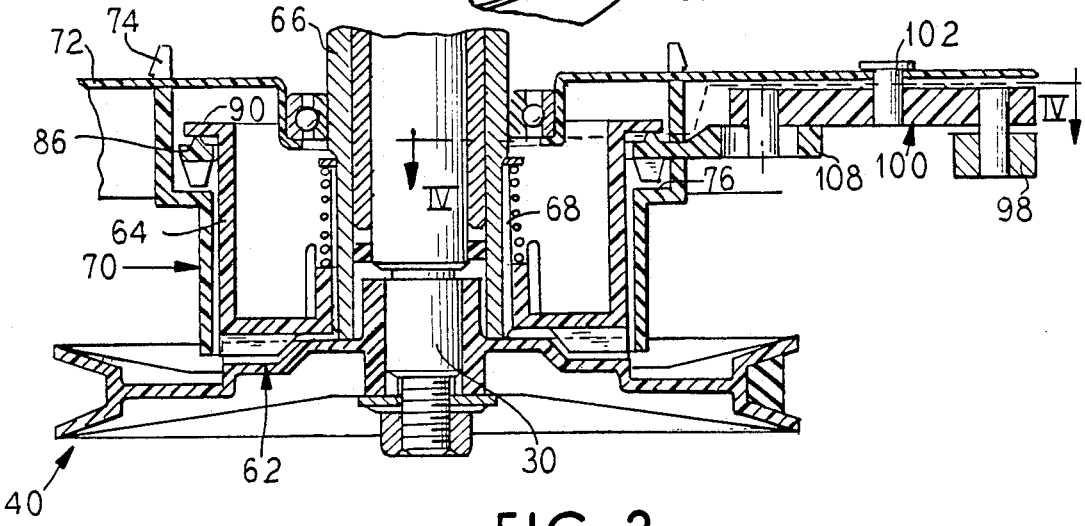
FIG. 3

AUTOMATIC WASHER BASKET AN AGITATOR DRIVE SYSTEM

BACKGROUND OF THE INVENTION

The present invention relates to drive systems for automatic clothes washers, and more particularly to a clutch mechanism to be incorporated in a vertical axis washer having a planetary drive system.

Automatic washers having a direct drive system between the motor and agitator/wash basket require a clutch mechanism so that the washer will be able to selectively operate in an agitate mode, wherein the agitator is oscillated while the basket is held stationary, and in a water extraction or "spin" mode, wherein the agitator and basket are spun together. Conventional machines utilizing this drive system incorporate a spring clutch or a spline clutch with a solenoid to actuate the clutch, moving the clutch member vertically on the motor shaft to selectively engage or disengage a drive connection with the wash basket.

Spring clutch mechanisms use a wrap spring clutch, in which the torsional tension in a coil spring encircling a drive shaft is varied such that the coil spring selectively grips or idles on the shaft. In this manner, the motor drive shaft is coupled to the wash basket drive system. Wrap spring clutches are typically expensive due to the tolerances and process controls required for reliable operation.

Previously known spline clutch and solenoid mechanisms are usually complicated arrangements, requiring precisely machined mating surfaces and complicated actuation mechanisms. The complexity of such arrangements renders them relatively expensive and unreliable.

It would therefore be an improvement in the art if a less expensive and more reliable arrangement were provided which would nevertheless provide the necessary clutch function of shifting between the agitate mode and the spin mode.

SUMMARY OF THE INVENTION

The present invention contemplates a cam actuated clutch mechanism for use in an automatic washer having a vertical axis agitator, a concentrically mounted wash basket, and a motor drivingly connected to the agitator to selectively oscillate or rotate the agitator about a vertical axis. The clutch mechanism selectively drivingly connects the wash basket with the motor for simultaneous rotation of the agitator and the wash basket during a spin cycle.

In an exemplary embodiment, the clutch mechanism includes first and second clutch members, with the second clutch member being drivingly connected to the wash basket and selectively actuable to drivingly engage the first clutch member. A stationary cam housing is located adjacent to the second clutch member, and a rotatable ring is disposed between the cam housing and the second clutch member. Cam surfaces are located between the rotatable ring and the cam housing, such that rotational movement of the ring is translated into axial movement of the second clutch member.

The clutch mechanism further includes a resilient member for biasing the second clutch member towards engagement with the first clutch member, and an actuation mechanism for producing rotary motion of the rotatable ring.

The clutch members have opposed planar engagement surfaces, each of which includes a series of alternating radial splines and grooves. During engagement of the first and second clutch members, the splines of each of the clutch members are received in the grooves of the other clutch member.

In the embodiment illustrated, the splines of the first clutch member have squared tips at their peaks, and the grooves of the second clutch member include corresponding squared troughs for receiving the squared tips.

The spline profile is a hybrid between a square tooth profile and a sawtooth profile. Square teeth have the advantage of secure engagement since, once the parts are engaged, the teeth cannot slip backwards past one another. However, square teeth are difficult to engage, since the parts must be perfectly aligned. This presents a severe problem when the parts are moving prior to their engagement, as is the case in washing machine clutches. A sawtooth profile is easier to engage, since the tip of each spline has a greater chance to penetrate its opposing groove. However, a sawtooth spline is more likely to experience "backlash", where the teeth slip backwards past one another if the driving part decelerates slightly, such as when the motor is briefly de-energized as is common in washing machine operation.

The hybrid face splines have a predominantly sawtooth profile so that moving engagement is possible. The square peaks and corresponding recesses take advantage of the secure engagement of square teeth. As mentioned previously, the motor is briefly de-energized shortly after it is turned on, and a spring or other resilient member is provided between the clutch members to completely drive the splines into their opposing grooves. After the squared tip enters the square recess, the splines are prevented from slipping backwards past one another, thus eliminating "backlash".

Other objects and advantages of the present invention will become apparent upon reference to the accompanying description when taken in conjunction with the following drawings.

BRIEF DESCRIPTION OF THE DRAWINGS

FIG. 3 is a side sectional view of the clutch assembly of the present invention in its engaged position.

FIG. 4 is a top view partially broken away taken along line IV—IV of FIG. 3.

FIG. 5 is a side sectional view of the clutch assembly of the present invention shown in its disengaged position.

FIG. 7 is a sectional view taken generally along line VII—VII of FIG. 5.

FIG. 8 is a detailed sectional view of one of the splines of FIG. 7.

DESCRIPTION OF THE PREFERRED EMBODIMENT

Figure 1:
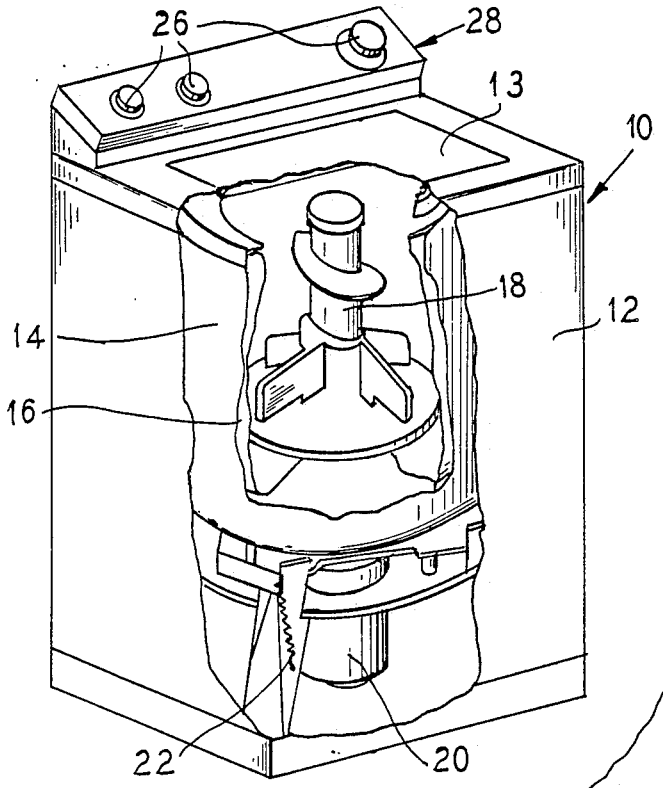
FIG. 1 is a perspective view of an automatic washer embodying the principles of the present invention.

In FIG. 1 there is illustrated an automatic washer generally at 10 embodying the principles of the present invention. The washer has an outer cabinet 12 with an openable lid 13 which encloses an imperforate wash tub 14 for receiving a supply of wash liquid. Concentrically mounted within the wash tub is a wash basket 16 for receiving a load of materials to be washed and a vertical axis agitator 18. A motor 20 is provided which is drivingly connected to the agitator 18 to drive it in an oscillatory or rotary manner, and is also selectively connectable to the basket 16 for simultaneous rotation with the agitator 18. The assembly of the tub 14, wash basket 16, agitator 18, and motor 20 is mounted on a suspension system 22. A plurality of controls 26 are provided on a control console 28 for automatically operating the washer through a series of washing, rinsing, and liquid extracting steps.

Figure 2:
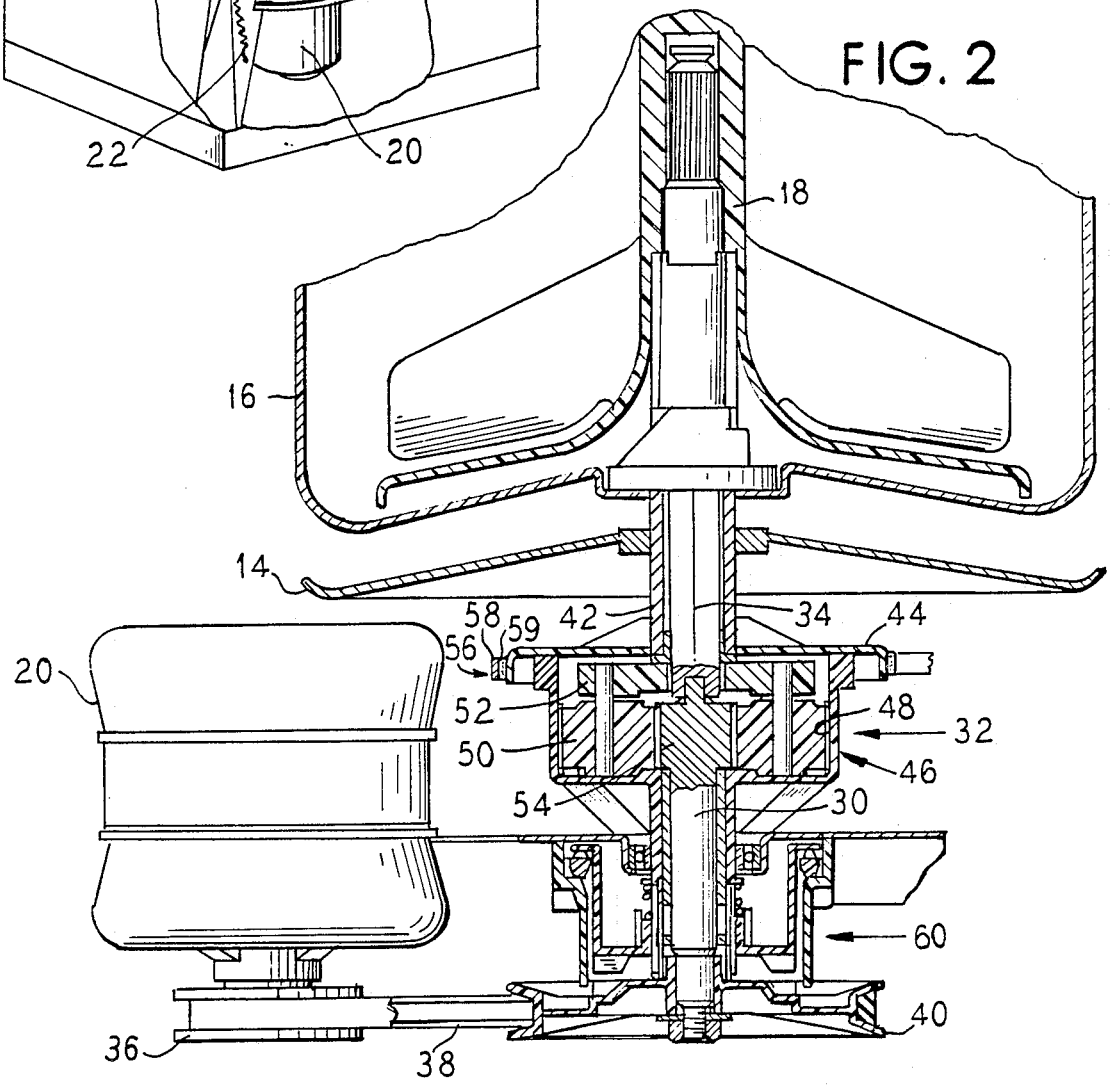
FIG. 2 is a side sectional view of the agitator and drive system of the washer of FIG. I.

The drive mechanism is shown in greater detail in FIG. 2, where it is seen that the motor 20 is connected through a drive shaft 30 to a gear arrangement, such as a planetary gear assembly 32, and to a vertical shaft 34 connected to the agitator 18. In this particular drive arrangement, the motor 20 may be a permanent split capacitor (PSC) motor, and is connected through a drive pulley 36 and a belt 38 to drive a driven pulley 40 affixed to the bottom of the drive shaft 30. The motor 20 may be reversely operated to provide oscillatory motion to the agitator. The wash basket 16 is connected to a spin tube 42, which is in turn connected to a hub surface 44 of a gear housing 46. The gear housing 46 includes an outer gear ring 48 which interacts with a plurality of planet gears 50. The vertical shaft 34 is connected to the planet gears 50 through the use of a connecting carrier plate 52, and a sun gear 54 is directly connected to the drive shaft 30.

When the washer is operating in the agitate mode, the motor 20 is operated in a reversing fashion which causes the drive shaft 30 to oscillate, thus driving the sun gear 54 in alternating opposite directions. The agitator 18 is therefore oscillated through its connection with the planet gears 50. The wash basket is held stationary during this operation, and to provide the means for holding the basket stationary, a band brake mechanism shown generally at 56 may be provided. The band brake mechanism 56 includes a brake band 58 having a high friction interior lining 59 which is engageable with at least a portion of the circumference of the hub 44 connected to the basket 16. The band brake 56 may be constructed and actuated as disclosed in commonly assigned and copending U.S. application No. 214,592, filed July 1, 1988, the specification of which is incorporated by reference herein.

Generally, in the agitate mode, the agitator 18 is oscillated through an angle of approximately 270° to 300° during each stroke. Often, it is desirable to hold the wash basket fixed relative to the wash tub during the agitate mode. This is accomplished by leaving the brake mechanism 56 in an "on" condition. However, during the water extraction step, the basket 16 is spun with the agitator 18. During this step the brake mechanism 56 is released from frictional engagement with the hub 44.

A clutch mechanism is required to provide a way of switching between oscillatory movement of the agitator relative to the basket, and spinning of the agitator with the basket. The present invention contemplates an improved and simplified clutch assembly 60, as shown in FIGS. 3 through 8. The clutch assembly 60 includes a clutch plate 62 integrated into the surface of the driven pulley 40, and a clutch slider 64. The clutch slider 64 is mounted for vertical movement on a cylindrical portion 66 of the gear housing 46 by means of vertical splines 68. A stationary cam housing 70 concentrically surrounds the clutch slider 64, and is secured to a mounting plate 72 of the washer 10 by a plurality of retaining tabs 74. The cam housing 70 also includes an inner annular rim 76 upon which are mounted a plurality of cam surfaces, shown in FIG. 6 as angularly spaced upwardly directed ramps 78. The clutch slider 64 is biased toward engagement with the clutch plate 62 by a spring or other resilient or elastic member 80, shown in FIG. 5 as being retained concentrically surrounding the cylindrical portion 66, between an inner cylinder 82 of the clutch slider 64 and a clip-ring spring abutment 84.

Figure 6:
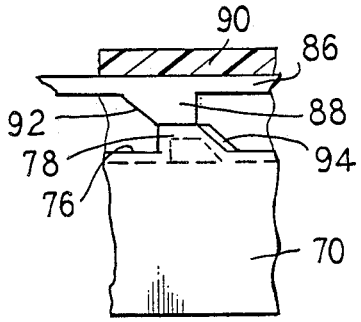
FIG. 6 is a sectional view taken generally along line VI—VI of FIG. 5.

A rotatable ring 86, upon which are mounted angularly spaced, downwardly directed cam followers 88, is disposed between the annular rim 76 of the cam housing 70 and an abutment edge 90 of the clutch slider 64. Rotation of the ring 86 causes inclined surfaces 92 of the cam followers 88 to slide along inclined surfaces 94 of the cam housing 70 (FIG. 6). This rotation causes axial displacement of the clutch slider 64, due to contact between the ring 86 and the abutment edge 90 of the clutch slider 64. Rotation of the ring 86 may be achieved by an actuator 96 (for example, a solenoid actuator), acting through an actuator rod 98 to pivot a linkage 100 about a pivot pin 102. One end 104 of the linkage 100 is connected to the actuator rod 98, while another end 106 of the linkage 100 is connected to a lever arm 108 of the rotatable ring 86. Operation of the actuator 96 pivots the linkage 100, thus rotating the ring 86 and axially displacing the clutch slider 64.

Details of opposed engagement surfaces 110 and 112 of the clutch plate 62 and the clutch slider 64 are best illustrated in FIGS. 7 and 8. The engagement surface 110 of the clutch plate 62 includes a series of radially extending alternating splines 114 and grooves 116 disposed on the surface thereof. The splines 114 are provided with squared peaks 118. The engagement surface 112 of the clutch slider 64 includes a corresponding series of radially extending alternating splines 120 and grooves 122. The grooves 122, at their inner most portions 123, include square recesses 124 which are similar in size and dimension to the squared peaks 118 of the splines 114.

As can be seen in FIG. 8, each of the splines 114 includes a first surface 130 extending perpendicularly from the engagement surface 110 to a first predetermined point 132. A second surface 134 extends from the first predetermined point 132, parallel to the engagement surface 110, to a second predetermined point 136. A third surface 138 extends from the second predetermined point 136, downwardly toward the engagement surface 110 and parallel to the first surface 130, to a third predetermined point 140. A fourth surface 144 extends from the third predetermined point 140 outwardly and obliquely from the first surface 130, to the engagement surface 110.

As can be seen from FIG. 7, the grooves 122 of the clutch slider 64 correspond in shape to the splines 114 of the clutch plate 62, and the splines 120 of the clutch slider 64 correspond in shape to the grooves 116 of the clutch plate 62. During driving engagement of the clutch plate 62 and the clutch slider 64, the resilient or elastic member 80 urges the clutch slider 64 downwardly so that splines 114 are received in grooves 122 and splines 120 are received in grooves 116. This arrangement provides an easily achieved yet secure engagement between the clutch members.

Although the present invention has been described with reference to a specific embodiment, those of skill in the art will recognize that changes may be made thereto without departing from the scope and spirit of the invention as set forth in the appended claims.

The embodiments of the invention is which an exclusive property or privilege is claimed are defined as follows:

1. An automatic washer having a vertical axis agitator, a concentrically mounted wash basket, a motor drivingly connected to said agitator to selectively oscillate or rotate said agitator about said vertical axis, and a clutch means for selectively drivingly connecting said wash basket with said motor for simultaneous rotation of said agitator and said wash basket, said clutch means comprising the following:

first engagement means drivingly connected to said motor;

second engagement means drivingly connected to said wash basket and selectively axially actuable for driving engagement with said first engagement means;

a stationary cam housing adjacent to said second engagement means;

a rotatable ring disposed between said cam housing and said second engagement means; and cam means disposed between said ring and said cam housing for selectively actuating said second engagement means into driving engagement with said first engagement means upon rotation of said ring with respect to said cam housing.

2. An automatic washer according to claim 1, wherein said cam means further comprises the following:

upwardly directed ramps on said cam housing; and cam follower means, attached to said ring, for interacting with said ramps to translate rotation of said ring into relative axial movement of said first and second engagement means.

3. An automatic washer according to claim 1, wherein said clutch means further comprises resilient means for biasing said second engagement means towards driving engagement with said first engagement means.

4. An automatic washer according to claim 1, wherein said clutch means further comprises actuation means for producing rotary motion of said rotatable ring relative to said cam housing.

5. An automatic washer according to claim 1, wherein said clutch means further comprises:

radially extending alternating first splines and first grooves disposed on said first engagement means and having a generally sawtooth profile;

radially extending alternating second splines and second grooves disposed on said second engagement means and having a generally sawtooth profile; and wherein, during driving engagement of said first and second engagement means, said first splines are received in said second grooves, and said first grooves receive said second splines.

6. An automatic washer according to claim 5, wherein said clutch means further comprises:

a squared tip at a peak of each of said first splines; and a squared recess, corresponding in shape to said square peaks, at an innermost portion of each of said second grooves.

7. An automatic washer having a vertical axis agitator, a concentrically mounted wash basket, a gear case housing drivingly connected to said basket, a motor drivingly connected to said agitator to selectively oscillate or rotate said agitator about said vertical axis, and a clutch means for selectively drivingly connecting said wash basket with said motor for simultaneous rotation of said agitator and said wash basket, said clutch means comprising the following:

first engagement means drivingly connected to said motor;

second engagement means drivingly connected to said gear case housing, said second engagement means having an annular abutment edge formed thereon;

a stationary cam housing surrounding at least part of said gear case housing and said second engagement means, said cam housing having an annular rim formed therein, s id rim having a plurality of angularly spaced upwardly directed ramps formed thereon; and a rotatable ramp ring disposed in said cam housing above said annular rim and beneath said abutment edge of said second engagement means, said ramp ring having a plurality of angularly spaced downwardly directed cam followers formed thereon such that rotation of said ramp ring within said cam housing causes said cam followers to interact with said upwardly directed ramps to axially shift said second engagement means relative to said first engagement means.

8. An automatic washer according to claim 7, wherein said clutch means further comprises resilient means for biasing said second engagement means into driving engagement with said first engagement means.

9. An automatic washer according to claim 7, wherein said clutch means comprises actuation means for producing rotary motion of said ramp ring relative to said cam housing.

10. An automatic washer according to claim 7, further wherein said clutch means comprises vertical splines drivingly connecting said gear case housing with said second engagement means.

11. An automatic washer according to claim 7, wherein said clutch means further comprises:

radially extending alternating first splines and first grooves disposed on said first engagement means and having a generally sawtooth profile;

radially extending alternating second splines and second grooves disposed on said second engagement means and having a generally sawtooth profile; and wherein, during driving engagement of said first and second engagement means, said first splines are received in said second grooves, and said first grooves receive said second splines.

12. An automatic washer according to claim 11, wherein said clutch means further comprises:

a squared tip at a peak of each of said first splines; and a squared recess, corresponding in shape to said square peaks, at a top of each of said second grooves.

13. An automatic washer having a vertical axis agitator, a concentrically mounted wash basket, a motor drivingly connected to said agitator to selectively oscillate or rotate said agitator about said vertical axis, a clutch means for selectively drivingly connecting said wash basket with said motor for simultaneous rotation of said agitator and said wash basket, said clutch means comprising the following:

first engagement means drivingly connected to said motor;

second engagement means drivingly connected to said wash basket;

radially extending alternating first splines and first grooves disposed on said first engagement means and having a generally sawtooth profile;

radially extending alternating second splines and second grooves disposed on said second engagement means and having a generally sawtooth profile;

a squared tip at a peak of each of said first splines;

a squared recess, corresponding in shape to said square peaks, at an innermost portion of each of said second grooves; and wherein, during driving engagement of said first and second engagement means, said first splines are received in said second grooves, and said first grooves receive said second splines.

14. An automatic washer according to claim 13, further wherein a ratio of a width of each of said square tips to a width of each of said splines is approximately 1/6.

15. An automatic washer according to claim 13, wherein said clutch means further comprises the following:

said second engagement means being selectively axially actuable for driving engagement with said first engagement means;

a stationary cam housing adjacent to said second engagement means;

a rotatable ring disposed between said cam housing and said second engagement means; and cam means disposed between said ring and said cam housing for selectively actuating said second engagement means to drivingly engage said first engagement means upon rotation of said ring with respect to said cam housing.

16. A clutch mechanism including first and second clutch members defining parallel first and second opposed planar engagement surfaces being rotatable in a predetermined drive direction about a common axis perpendicular to said opposed engagement surfaces, said clutch members comprising the following:

alternating first splines and first grooves on said first clutch member, axially protruding from a portion of said first opposed engagement surface, with each of said first splines including the following:

a first side extending outwardly perpendicular to said engagement surface to a first predetermined point;

a second side extending parallel to said engagement surface from said first predetermined point to a second predetermined point;

a third side extending parallel to said first side from said second predetermined point toward said engagement surface to a third predetermined point; and a fourth side extending obliquely from said third predetermined point to said engagement surface;

alternating second splines and second grooves on said second clutch member, wherein, during driving engagement of said first and second clutch members, said first splines are received in said second grooves, and said first grooves receive said second splines.

17. A clutch mechanism according to claim 16, further comprising the following:

a stationary cam housing adjacent to said second clutch member;

a rotatable ring disposed between said cam housing and said second clutch member; and cam means disposed between said ring and said cam housing for selectively actuating said second clutch member to drivingly engage said first clutch member upon rotation of said ring with respect to said cam housing.

18. A clutch mechanism according to claim 17, wherein said cam means further comprises the following:

upwardly directed ramps on said cam housing; and cam follower means, attached to said ring, for interacting with said ramps to translate rotation of said ring into relative axial movement of said first and second clutch member.

19. A clutch mechanism according to claim 17, further comprising resilient means for biasing said second clutch member towards engagement with said first clutch member.

20. A clutch mechanism according to claim 17, further comprising actuation means for producing rotary motion of said rotatable ring relative to said cam housing.

* * * * *